US008261705B2

(12) United States Patent
Lancefield et al.

(10) Patent No.: US 8,261,705 B2
(45) Date of Patent: Sep. 11, 2012

(54) CAMSHAFT AND PHASER ASSEMBLY

(75) Inventors: Timothy Mark Lancefield, Shipston on Stour (GB); Ian Methley, Witney (GB); Richard Alwyn Owen, Banbury (GB)

(73) Assignee: Mechadyne PLC, Kirtlington (GB)

( * ) Notice: Subject to any disclaimer, the term of this patent is extended or adjusted under 35 U.S.C. 154(b) by 245 days.

(21) Appl. No.: 12/514,434

(22) PCT Filed: Dec. 4, 2007

(86) PCT No.: PCT/GB2007/050736

§ 371 (c)(1),
(2), (4) Date: May 11, 2009

(87) PCT Pub. No.: WO2008/075094

PCT Pub. Date: Jun. 26, 2008

(65) Prior Publication Data

US 2010/0050967 A1 Mar. 4, 2010

(30) Foreign Application Priority Data

Dec. 19, 2006 (GB) ..... 0625256.3

(51) Int. Cl.
*F01L 1/34* (2006.01)

(52) U.S. Cl. ..... 123/90.17; 123/90.15

(58) Field of Classification Search ..... 123/90.12, 123/90.15, 90.17, 90.6; 74/567, 568 R
See application file for complete search history.

(56) References Cited

U.S. PATENT DOCUMENTS

| | | | | |
|---|---|---|---|---|
| 5,509,384 | A | 4/1996 | Schmid | |
| 6,725,817 | B2 * | 4/2004 | Methley et al. | 123/90.17 |
| 6,772,721 | B1 * | 8/2004 | Gardner et al. | 123/90.17 |
| 6,845,740 | B2 * | 1/2005 | Kohrs | 123/90.17 |
| 7,287,499 | B2 * | 10/2007 | Lawrence et al. | 123/90.17 |
| 7,513,232 | B2 * | 4/2009 | Schneider | 123/90.17 |
| 7,958,859 | B2 * | 6/2011 | Methley et al. | 123/90.6 |
| 2002/0059910 | A1 * | 5/2002 | Methley et al. | 123/90.17 |
| 2005/0034694 | A1 | 2/2005 | Williams | |
| 2005/0235939 | A1 | 10/2005 | Wilke | |
| 2006/0185471 | A1 | 8/2006 | Lawrence et al. | |
| 2006/0207538 | A1 * | 9/2006 | Lancefield et al. | 123/90.17 |

FOREIGN PATENT DOCUMENTS

DE 19757504 A1 7/1999

* cited by examiner

*Primary Examiner* — Thomas Denion
*Assistant Examiner* — Daniel Bernstein
(74) *Attorney, Agent, or Firm* — Chernoff, Vilhauer, McClung & Stenzel

(57) ABSTRACT

An assembly is provided comprising an SCP camshaft (130) having an inner shaft (140) and an outer tube (124) and a hydraulically operated twin vane phaser (110) having two output members (114, 116) coupled respectively for rotation with the inner shaft (140) and the outer tube (124) of the SCP camshaft (130). Each of the output members (114, 116) of the twin phaser is axially clamped to a respective one of the inner shaft (140) and the outer tube (124) of the SCP camshaft (130). A support bearing (150) for the twin vane phaser (110), having passageways (142) for supplying pressure medium to working chambers of the twin vane phaser (110), is formed separately from the SCP camshaft (130).

8 Claims, 3 Drawing Sheets

CAMSHAFT AND PHASER ASSEMBLY

CROSS-REFERENCE TO RELATED APPLICATIONS

This is a national stage application filed under 35 USC 371 based on International Application No. PCT/GB2007/050736 filed Dec. 4, 2007, and claims priority under 35 USC 119 of United Kingdom Patent Application No. 0625256.3 filed Dec. 19, 2006.

FIELD OF THE INVENTION

The present invention relates to an assembly comprising an a single cam phaser (SCP) camshaft and a phaser.

BACKGROUND OF THE INVENTION

Assembled camshafts are known which comprise an inner shaft and an outer tube that are rotatable relative to one another. A first set of cams is secured for rotation with the outer tube while a second set of cams is rotatably mounted on the outer tube and connected for rotation with the inner shaft by way of pins that pass through slots in the outer tube that extend circumferentially. Such a camshaft, which allows the relative phase of adjacent cams rotatable about a common axis to be changed, is known (for example from EP-A-1 362 986) and is commonly and herein referred to as a single cam phaser (abbreviated to SCP) camshaft.

There are also known hydraulically operated vane-type cam phasers that are intended to drive an SCP camshaft, an example of such a phaser being disclosed in U.S. Pat. No. 6,725,817. Such phasers will herein be referred to as twin phasers, because they have two output members, one for driving the inner shaft of the SCP camshaft and the other for driving its outer tube. The phase of at least one, or more preferably both, of the output members are adjustable hydraulically relative to the engine crankshaft, such as by controlling the flow of oil under pressure to arcuate working chambers arranged on opposite sides of radial vanes connected to a respective one of the output members.

The present invention is concerned with the manner in which a twin phaser is fitted to an SCP camshaft.

Reference will now be made to FIG. 1, which is an axial section showing a twin phaser 10 mounted on an SCP camshaft 30 in a known manner, to explain some of the problems encountered in the prior art.

In FIG. 1, the twin phaser 10 has a stator 12 fitted with a sprocket 20 to be driven by the engine crankshaft. Front and rear end plates 14 and 16 are connected to radial vanes (not shown) that are movable in arcuate working chambers in the stator 12 and serve as output members.

The internal construction of the phaser 10 is not shown in detail in FIG. 1, the only part showing in the section of the drawing being a spring loaded pin 18 for locking the front plate 14 to the stator 12 under certain conditions.

The rear end plate 16 is coupled by means of dowel pins 22 to a bearing 24 that is fast in rotation with the outer tube 26 of the SCP camshaft 30. The outer tube 26 is fast in rotation with some of the cam sleeves, such as the cam sleeve 28. Other cam sleeves, such as the sleeve formed with two cam profiles 32 and 34 are coupled by driving pins 36 for rotation with the inner shaft 40 of the SCP camshaft 30. A nose portion 50, which is integral with or permanently secured to the inner shaft 40, passes through the stator 12 and receives a nut 44 that clamps onto the front end plate 14 of the twin phaser 10, whereby the inner shaft 40 rotates with the front end plate 14 while the outer tube 16 rotates with the bearing 24 and the rear end plate 16. The nose portion 50 is also formed with oil galleries 42 terminating in grooves which supply oil to the working chambers of the twin phaser 10.

Whilst the above provides a functional design solution, it presents certain problems which are addressed by the present invention and which will now be explained.

A first problem encountered in the prior art is additional friction between the inner shaft 40 and outer tube 26 of the SCP camshaft 30. The reason for this is that all the chain/belt loads from the sprocket 20 are transferred onto the cam nose 50 and then onto the bearing surface, designated 38 in FIG. 1, between the inner shaft 40 and the outer tube 26. This potentially affects the performance of the valve system by introducing undesirable friction between these two components of the camshaft 30.

A second problem in the prior art is that the inner shaft 40 is subjected to both bending forces and torque and needs to be supported inside the outer tube 26. This makes the SCP camshaft design very sensitive to manufacturing tolerances because the inner shaft 40 is located by both the bearings in the outer tube 26 and the connecting pins 36. The improved SCP camshaft design described in GB Pat. Appln. No. 0522328.7 requires the inner shaft 40 to be subjected to torque only.

Further problems with the prior art result from the fact that it is difficult to assemble the phaser 10 onto the camshaft 30. The assembly of twin phasers onto SCP camshafts is inherently more complex than the assembly of a standard sprocket to a solid camshaft. It is usually not possible to install the camshaft and phaser as one complete unit as a camshaft thrust control plate between these two parts. The fixings for the thrust plate are usually so arranged that the only method of assembly is first to install the camshaft in the engine, then to bolt the thrust plate in place and finally to assemble the phaser to the front of the camshaft with the chain and crank sprocket.

A third problem with the prior art is that the support bearing for the phaser assembly 10 is part of the cam nose 50 and therefore forms a part of the camshaft assembly. The bearing surfaces are thus exposed to dirt and debris during the assembly operation, and if these were to be contaminated, the phaser could be caused to malfunction. It is also impossible to properly test the twin phaser assembly 10 as a unit before it is fitted to the SCP camshaft assembly 30 because it only becomes united with its support bearing at the time of assembly.

A fourth problem with the prior art is that the two dowel pins 22 that are used to transmit torque from the rear plate 16 to the outer tube assembly 24, 26 are difficult to align and require tight manufacturing tolerances on both mating parts. Assembly of the twin phaser is therefore relatively complicated, requiring skilled manual procedures that could potentially slow down the production line.

A fifth problem with the prior art is that the phaser 10 is not clamped axially to the front bearing 24 of the SCP camshaft 30 because the driving connection is achieved with dowel pins 22. This means that the relative axial positions of the inner shaft 40 and outer tube 26 of the SCP camshaft need to be dictated by thrust control features on the SCP camshaft and cannot be controlled by the phaser.

OBJECT OF THE INVENTION

The present invention seeks to mitigate at least some of the above problems all of which create difficulties that are difficult to overcome in a high-volume production environment.

SUMMARY OF THE INVENTION

According to the present invention, there is provided an assembly comprising an SCP camshaft having an inner shaft, an outer tube and a hydraulically operated twin phaser having two output members coupled respectively for rotation with the outer tube and the inner shaft of the SCP camshaft, wherein each of the output members of the twin phaser is axially clamped to a respective one of the outer tube and the inner shaft of the SCP camshaft, and a bearing support for the twin vane phaser, having passageways for supplying pressure medium to working chambers of the twin vane phaser, is formed separately from the SCP camshaft.

Preferably, the bearing support is clamped together with one output member of the twin vane phase to the outer tube of the SCP camshaft. This will result in the driving torque from one of the phaser outputs being transmitted directly to the outer tube.

The other output member of the vane type phaser may conveniently be clamped by means of one or more fixings to the inner shaft of the SCP camshaft.

Advantageously, all fixings clamping the output members of the phaser to the inner shaft and the outer tube of the SCP camshaft are accessible from the end of the phaser remote from the SCP camshaft.

BRIEF DESCRIPTION OF THE DRAWINGS

The invention will now be described further, by way of example, with reference to the accompanying drawings, in which:—

DETAILED DESCRIPTION OF THE PREFERRED EMBODIMENT(S)

Figure 1:
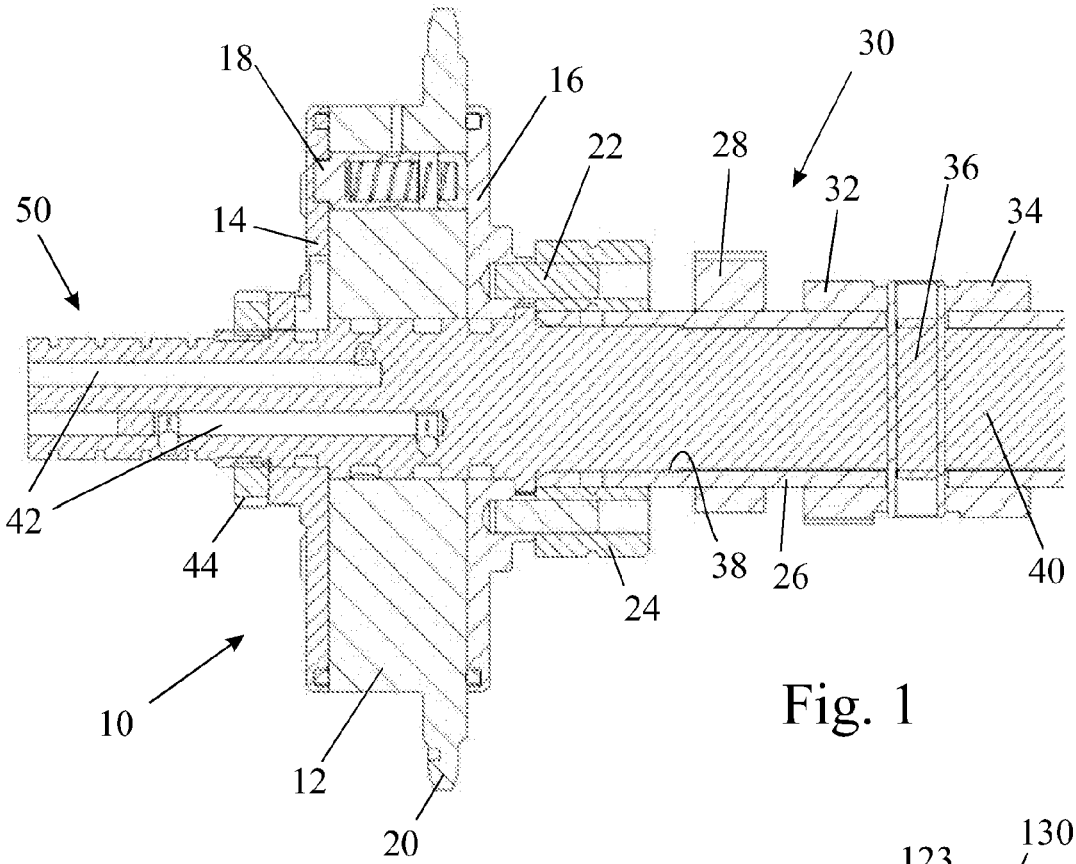
FIG. 1 is, as previously described, an axial section showing a twin phaser secured in a known manner to an SCP camshaft.
Figure 2:
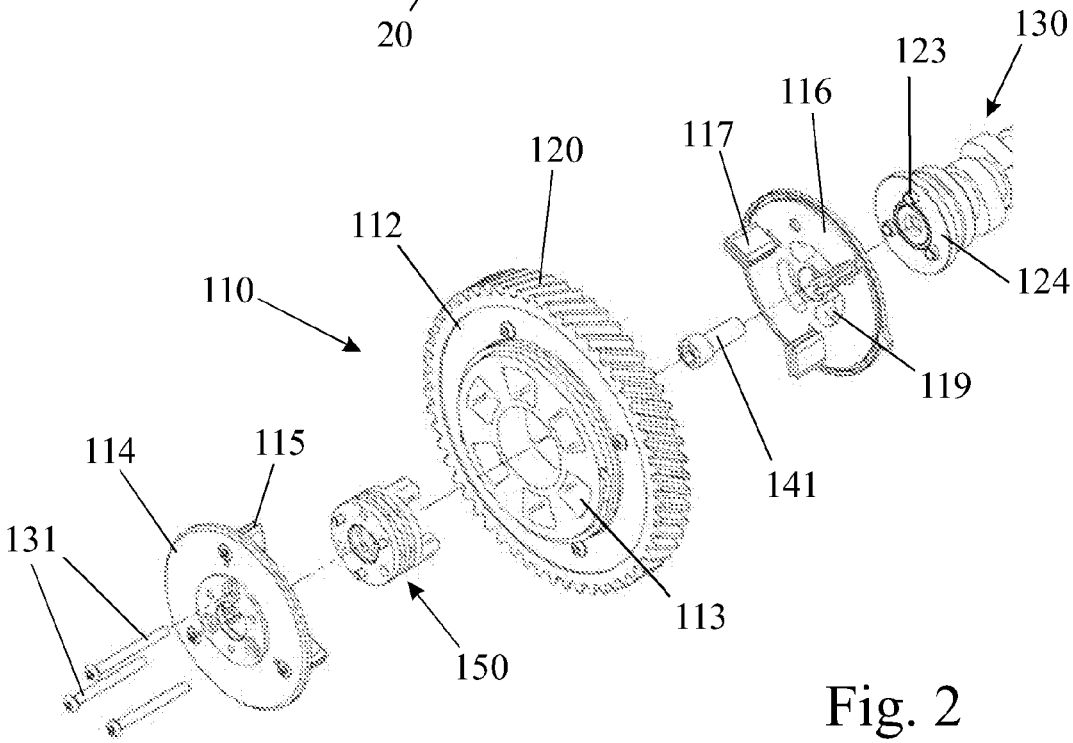
FIG. 2 shows an exploded view of a camshaft and twin phaser assembly of the present invention.
Figure 3:
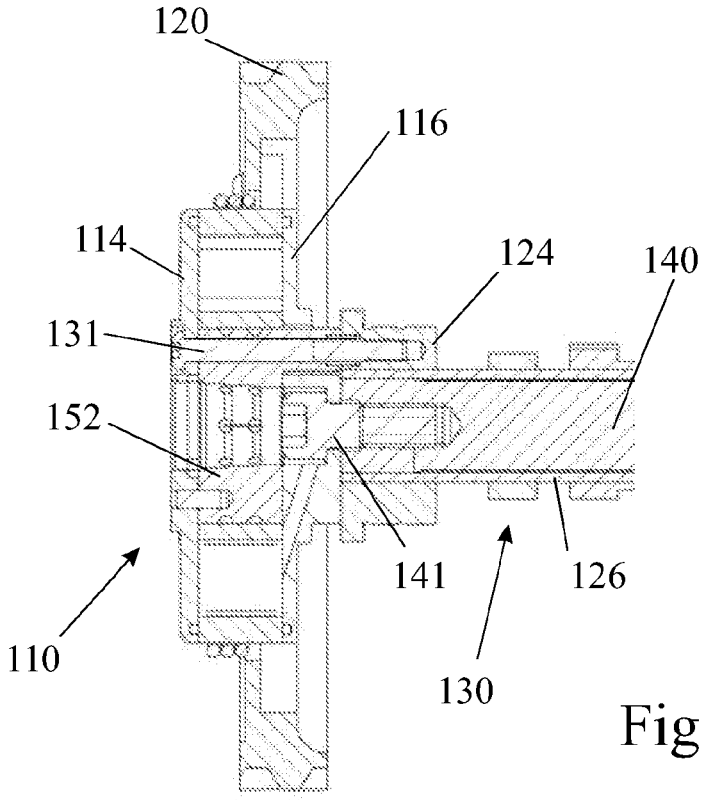
FIG. 3 is a section similar to that of FIG. 1 of the embodiment of the invention in FIG. 2.

A twin phaser 110 in which the phase of each of the output members is adjustable relative to the engine crankshaft is shown in the exploded view of FIG. 2. The stator 112 serving as the input member of the twin phaser 110 is formed in this embodiment as a gear 120 rather than a sprocket because it is designed to be gear driven from the crankshaft, instead of being chain driven. The stator 112 is annular and has six arcuate recesses 113. Three of the recesses receive vanes 115 projecting from the front end plate 114 and the other three receive vanes 117 projecting from the rear end plate 116, the two end plates 114 and 116 once again serving as the output members of the twin phaser 110.

The camshaft 130 terminates near the front bearing 124 which is formed with three screw threaded holes receiving ring dowels 123.

Figure 4:
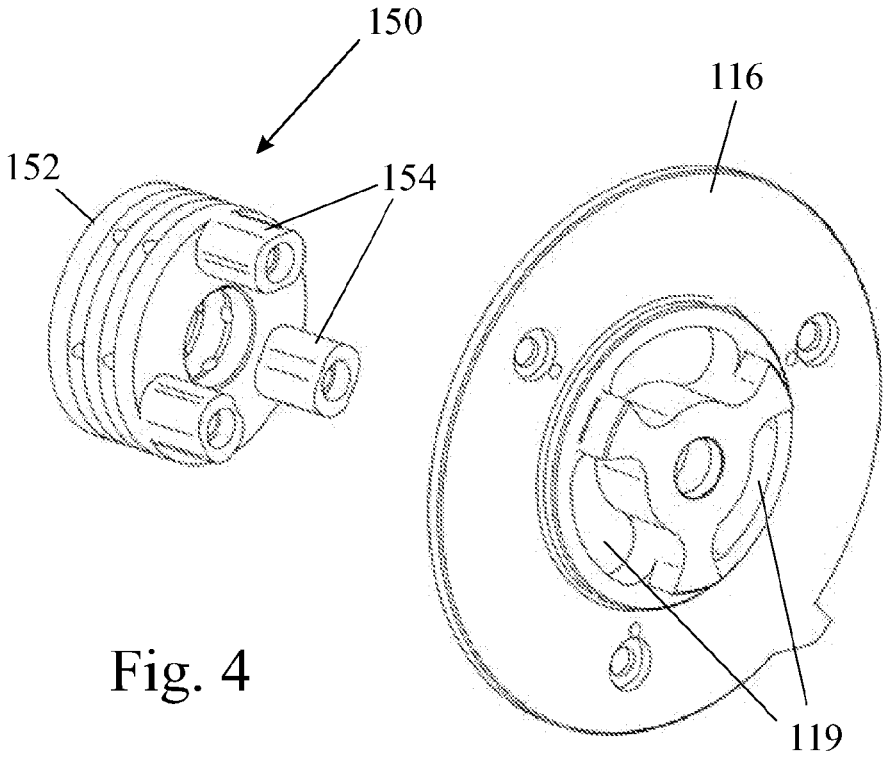
FIG. 4 is a perspective exploded view showing a support bearing and a rear output plate of the embodiment of the invention shown in FIG. 2.
Figure 5:
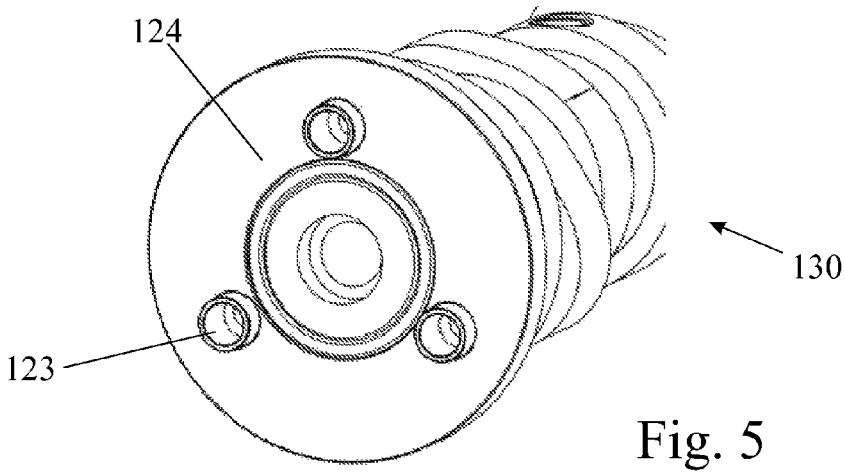
FIG. 5 is a front perspective view of the SCP camshaft assembly in FIG. 2.
Figure 6:
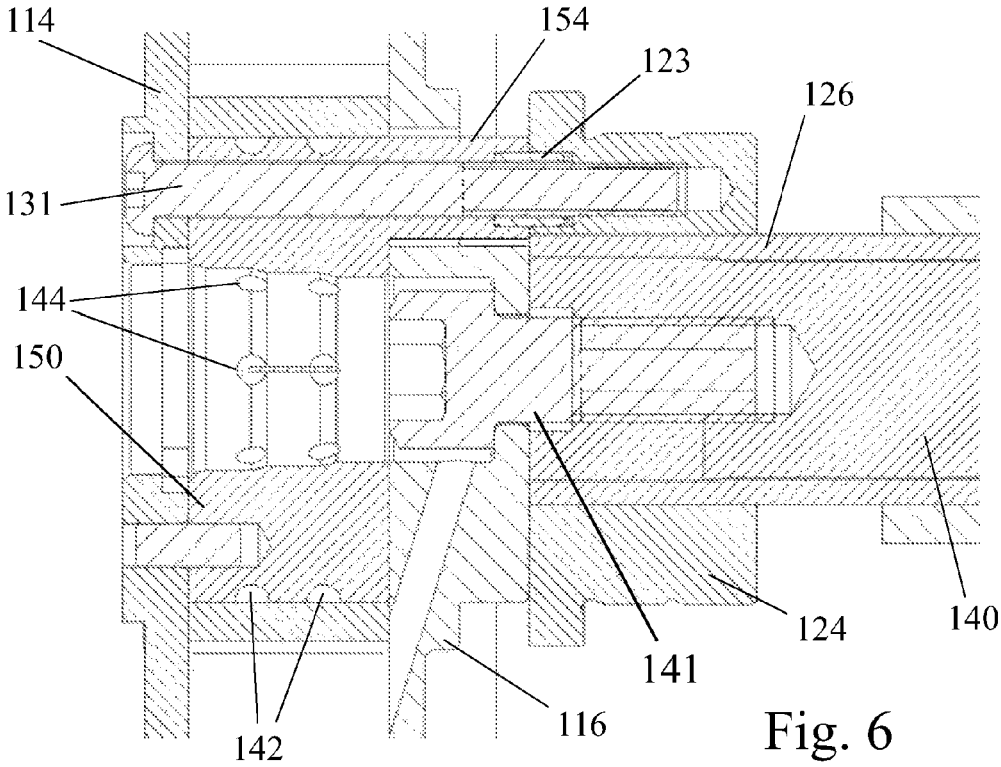
FIG. 6 shows part of the section of FIG. 3 drawn to an enlarged scale.

In place of a permanent nose on the camshaft, the twin phaser in the present invention is supported on a support bearing 150 shown in more detail in the section of FIG. 6 and in FIG. 4. The support bearing 150 comprises a ring 152 with three projecting hollow legs 154. The ring 152 is engaged in use by an oil feed spigot that projects from a cover overlying the front end of the engine block. The front cover may for example be an adaptation of that described in GB-A-2329675. The stator 112 of the twin phaser is in turn supported by the radially outer surface of the ring 152 and can rotate through only a few degrees relative to the ring 152. Various passageways 144 and oil grooves 142 in the ring 152 allow oil from the engine front cover to be supplied under pressure to the working chambers of the twin phaser.

The legs 154 of the support bearing 150 pass through three arcuate clearance slots 119 formed in the rear end plate 116 to contact the axial end face of the bearing 124, which is fast in rotation with the outer tube 126 of the SCP camshaft 130. The bearing support 150 is axially clamped between the front plate 114 of the twin phaser 110 and the bearing 124 by means of three bolts 131 which pass through the hollow legs 154 and clamp the front end plate 114, the support bearing 150 and the bearing 124 to one another. This ensures that the front end plate 114 is fixed both axially and rotationally in relation to the outer tube 126 of the SCP camshaft 130.

Additionally, the hollow legs 154 of the support bearing 150 are aligned in relation to the bearing 124 by means of the dowel rings 123 that project from the axial end surface of the bearing 124 into the hollow legs 154 of the support bearing 150.

Clearly it would be possible to form the front bearing 124 of the SCP camshaft 130 with hollow legs that locate against the rear of the support bearing 150 instead of forming them as part of the support bearing. It would also be possible to form the hollow legs 154 as separate components that are clamped between the support bearing 150 and the front bearing 124 of the SCP camshaft 130.

The rear end plate 116 of the twin phaser is directly secured onto the inner shaft 140 of the SCP camshaft 130 by means of a bolt 141 that is screw threaded into a bore in the axial end face of the inner shaft 140. A high friction washer may optionally be provided to ensure that the rear end plate 116 is fully prevented from rotating relative to the inner shaft 140 of the SCP camshaft 130.

The described preferred embodiment of the invention addresses all of the problems mentioned above, by providing the following features:

Both the front and rear plates 114 and 116, constituting the output members of the twin phaser, are securely clamped to the outer tube 126 and inner shaft 140, respectively, of the SCP camshaft 130 and no dowel pins or other features are relied upon to transmit torque from the phaser to the camshaft.

The support bearing 150, which supports the stator 112 of the twin phaser and replaces the cam nose 50 of the prior art, is formed separately from the SCP camshaft and is bolted to the front bearing through clearance slots 119 in the rear output end plate 116 of the twin phaser.

The support bearing 150 through which oil is conveyed to the twin phaser is aligned relative to the front bearing 124 by features, such as the dowel rings 123, which maintain it concentric with the front bearing 124.

The axial position of the inner shaft 140 of the SCP camshaft is determined by the twin phaser as the rear output end plate 116 is directly clamped to it.

The assembly can have a high-friction washer or other means, such as dowel pins to prevent the rear output end plate and the inner shaft 140 from rotating relative to one another.

By virtue of this design, the preferred embodiment of the invention offers the following benefits:

All the sprocket loads pass directly into the front cam bearing via the support bearing 150 thus significantly reducing friction in the SCP cam assembly. In this respect, it should be noted that the inner shaft is subjected only to a torque, not to radial bending loads.

Because only torque is applied to the inner shaft of the SCP camshaft, one can form the SCP camshaft in the manner described in GB Pat. Appln. No. 0522328.7, in which the inner shaft of the camshaft has no front support bearing and is instead centred in the outer tube by arranging for the pins 36 connecting the inner shaft 40 to different cam sleeves to be inclined relative to one another.

The complete twin phaser assembly 110 and the support bearing 150 form a single unit. This eliminates any possibility of dirt and debris entering the part during assembly and enables the twin phaser and SCP assemblies to be tested individually prior to assembly.

Assembly of the twin phaser to the SCP camshaft is simplified as it only requires the two assemblies to be correctly aligned and to secure them to one another by the three fixing bolts 131, and the centre bolt 141. This is much closer to the manner in which a conventional cam sprocket would be assembled with the heads of all the fixings securing the twin phaser to the SCP camshaft accessible from the front face of the twin phaser.

The axial position of the inner shaft 140 within the outer tube 126 is dictated by their respective connections to the phaser outputs 116, 114 and it is not necessary to provide any thrust control features on the SCP camshaft assembly 130 itself.

The invention claimed is:

1. An assembly comprising a camshaft and a hydraulically operated vane type phaser, the camshaft comprising an outer tube, an inner shaft mounted within the outer tube and rotatable relative thereto, a first set of cams secured for rotation with the outer tube, and a second set of cams rotatably mounted on the outer tube and connected for rotation with the inner shaft by way of pins that pass through circumferentially extending slots in the outer tube, and the phaser comprising an input member, and first and second output members that are axially clamped to the outer tube and the inner shaft of the camshaft, respectively, and the phase of at least one of which is adjustable relative to the input member, the assembly further comprising a support bearing formed separately from the camshaft on which the input member of the phaser is journalled and from the two output members of the phaser, the support bearing having passageways for supplying pressure medium to working chambers of the phaser and being axially clamped together with the first output member of the phaser to the outer tube of the camshaft, and wherein the second output member of the phaser is clamped by means of one or more fixings to the inner shaft of the camshaft.

2. An assembly as claimed claim 1, wherein all fixings that serve to clamp the output members of the phaser to the inner shaft and the outer tube of the camshaft are accessible from the end of the phaser remote from the camshaft.

3. An assembly as claimed in claim 1, wherein means are provided for aligning the support bearing of the phaser with the axis of the camshaft and for orientating the phaser with respect to the cam lobes of the camshaft.

4. An assembly as claimed in claim 3, wherein the means for aligning the support bearing of the phaser with the axis of the camshaft or orientating the phaser comprises one or more ring dowels.

5. An assembly as claimed in 1, wherein the support bearing is formed with axial projections that pass with clearance through the second output member to connect the support bearing to the camshaft.

6. An assembly as claimed in claim 1, wherein the camshaft is formed with axial projections that pass with clearance through the second output member to connect the support bearing to the camshaft.

7. An assembly as claimed in claim 1, wherein a high friction washer or surface coating is used to improve the transmission of torque from the phaser to the front end of the inner shaft of the camshaft.

8. An assembly as claimed in claim 1, wherein the axial position of the inner shaft of the camshaft within the outer tube is controlled solely by its connection to the phaser.

* * * * *